United States Patent [19]

Sweet et al.

[11] Patent Number: 4,595,378

[45] Date of Patent: Jun. 17, 1986

[54] TOY ACTION FIGURE

[75] Inventors: Roger H. Sweet, Long Beach; Edward Mayer, Los Angeles, both of Calif.

[73] Assignee: Mattel, Inc., Hawthorne, Calif.

[21] Appl. No.: 781,300

[22] Filed: Sep. 27, 1985

[51] Int. Cl.[4] ..... A63H 3/16

[52] U.S. Cl. ..... 446/99; 446/321

[58] Field of Search ..... 446/97, 99, 101, 369, 446/370, 373, 198, 321, 268, 376, 390, 100

[56] References Cited

U.S. PATENT DOCUMENTS

| | | | |
|---|---|---|---|
| 340,270 | 4/1886 | Yaggy . | |
| 396,381 | 1/1889 | Yaggy . | |
| 784,888 | 3/1905 | Reisner . | |
| 1,690,778 | 11/1928 | Ford | 446/369 |
| 3,009,267 | 11/1961 | Bezark | 446/373 X |
| 3,346,989 | 10/1967 | Ryan et al. | 446/198 |
| 3,944,691 | 3/1976 | Smith . | |
| 4,063,381 | 12/1977 | Deulofeu . | |
| 4,344,249 | 8/1982 | Goldfarb et al. | 446/101 |
| 4,439,162 | 3/1984 | Blaine . | |

FOREIGN PATENT DOCUMENTS

| | | |
|---|---|---|
| 2250506 | 4/1974 | Fed. Rep. of Germany . |
| 16916 | of 1886 | United Kingdom . |

*Primary Examiner*—Mickey Yu

*Attorney, Agent, or Firm*—Ronald M. Goldman; Melvin A. Klein; Daniel F. Sullivan

[57] ABSTRACT

A toy action figure having an inner core depicting a first character; and a removable outer shell covering the inner core and depicting a second character.

3 Claims, 5 Drawing Figures

TOY ACTION FIGURE

BACKGROUND OF THE INVENTION

This invention relates to toy action figures and, more particularly, to toy action figures capable of assuming different identities.

Toy action figures are well known to the prior art. Probably the best known of these figures is the Barbie TM doll manufactured and sold for an extensive period by the assignee of the present invention. There have been many other toy action figures manufactured which allow children to simulate different imaginery situations. For example, some toy action figures are modern counterparts of the ancient toy soldiers. Others emulate figures which might be encountered in space exploration or in the imagined future.

Most of these toy action figures have various movable parts and may be made to assume different positions. For example, some toy action figures may assume acrobatic poses; others may sit, stand, lie, kneel, squat, run, bend, and so on. Some of the more advanced figures change into different configurations. For example, a number of modern figures change from robots into automobiles or spaceships.

BRIEF SUMMARY OF THE INVENTION

It is an object of the present invention to provide a toy action figure which is capable of assuming different identities.

This and other objects are accomplished by a toy action figure which includes a central core figure having various, well-defined characteristics. Surrounding the central core figure is a shell depicting a second figure with entirely different characteristics. The shell is arranged for convenient removal so that the toy action figure may be rapidly changed from a figure having one set of characteristics to a figure having an entirely different set of characteristics. In a preferred embodiment of the invention, the exterior shell figure is a muscular hero while the internal core figure has reptilian characteristics.

BRIEF DESCRIPTION OF THE DRAWINGS

The invention will be become more apparent from the following detailed description taken together with the drawings in which.

DETAILED DESCRIPTION OF THE INVENTION

Figure 1:
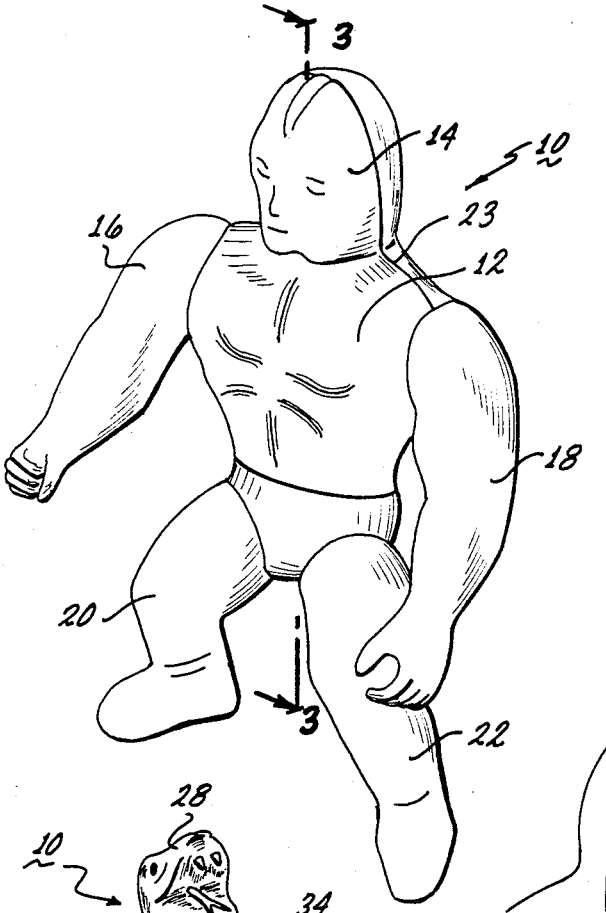
FIG. 1 is a perspective view of a toy action figure constructed in accordance with the invention with its external shell in place.

Referring now to FIG. 1, there is shown a toy action figure 10 having a torso 12, a head 14, a right arm 16, a left arm 18, a right leg 20, and a left leg 22. As may be discerned from FIG. 1, the toy action figure 10 has the appearance of a heroic, generally muscular he-man.

However, the toy action figure 10 shown in FIG. 1 is comprised of an inner core (not shown in FIG. 1) and an outer shell which covers its upper torso and upper limbs, more particularly, torso 12 from the waist up, arms 16 and 18, and head 14. A line 23 is shown in FIG. 1 which provides for the division of the shell covering the upper torso 12 and the head 14.

Figure 2:
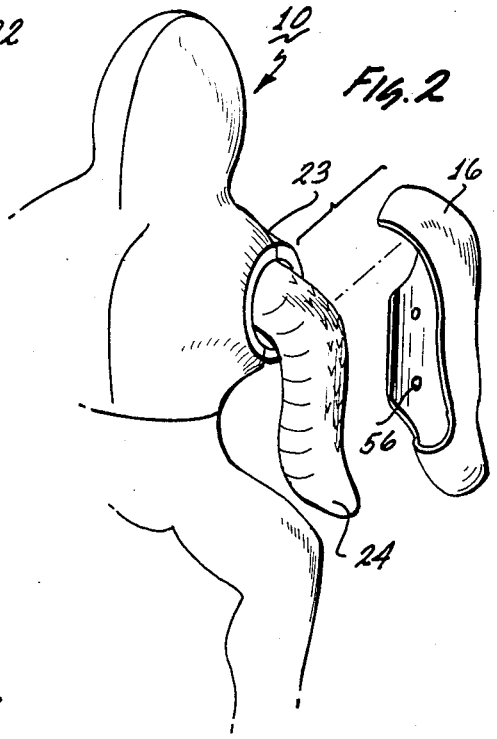
FIG. 2 is a partial perspective view of the toy action figure shown in FIG. 1 with a portion of the shell removed to disclose a portion of the core figure.
Figure 5:
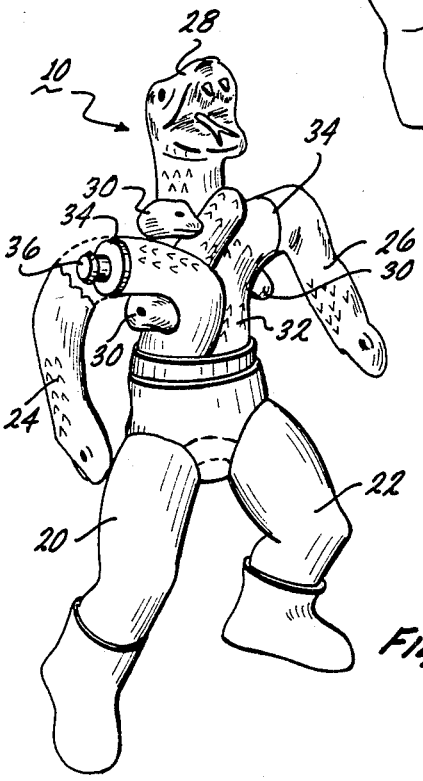
FIG. 5 is another perspective view of the toy action figure of FIG. 1 with the outer shell removed to disclose the core figure.

FIG. 2 illustrates the toy action figure 10 with the outer shell for the left arm 18 removed to disclose an inner arm 24 of an inner core figure which arm 24 is configured to resemble a snake. FIG. 5 illustrates the toy action figure 10 with the entire outer shell portion removed to illustrate an inner core figure which has arms 24 and 26 emulating snakes, an inner head 28 having a reptilian appearance, and a series of sculpted intertwined snakes 30 encircling an inner torso 32.

In a preferred embodiment of the invention, the inner core elements including the arms 24 and 26, the head 28, the torso 32, and the lower limbs 20 and 22 may all be constructed of a moldable plastic material such as polyvinyl chloride (PVC). Although not shown in the Figures, in the preferred embodiment, the lower limbs including the legs 20 and 22 are also constructed of PVC. The legs 20 and 22 are joined to and are movable in the lower torso in a well known ball and socket arrangement (not shown) and are connected together through the lower torso by a neoprine material which acts as an elastic and allows the placement of the legs 20 and 22 in different positions. A pair of lines 34 in FIG. 5 illustrate the separation of the arms 24 and 26 from the torso 32. A ball and socket joint 36 is shown in dotted lines at one of the lines 34; the joint 36 allows the articulation.

Figure 3:
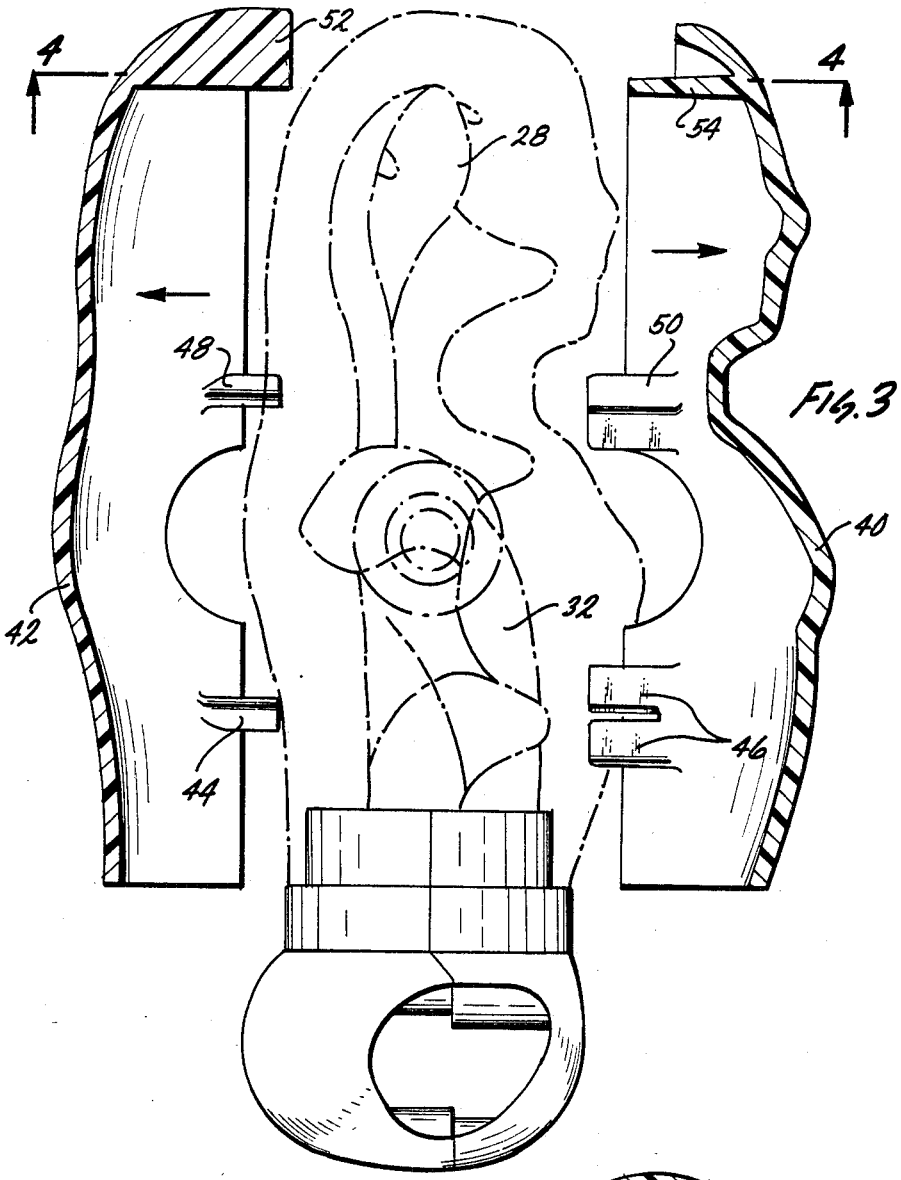
FIG. 3 is a cross-section taken along the lines 3—3 of FIG. 1.
Figure 4:
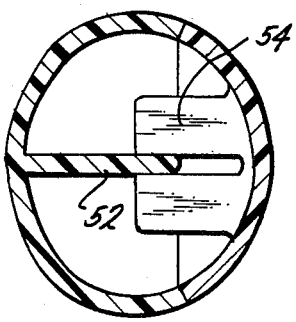
FIG. 4 is a cross-section taken along the lines 4—4 of FIG. 3.

FIG. 4 illustrates the arrangement of the shell covering the upper torso 32 and the head 28 of the inner core figure. The shell includes a front portion 40 configured to overlie the front portion of the upper torso 32 and of the head 28 and a rear portion 42 configured to overlie the back portion of the upper torso 32 and of the head 28. As may be seen in FIG. 3, each of the front and rear portions 40 and 42 comprises a thin shell which may be made of a moldable plastic material such as acrylonitrile butadiene styrene (ABS) in the preferred embodiment. Each of the shells 40 and 42 has on its inner surface fixtures for connecting the two portions 40 and 42 together in a friction fit. For example, the shell 42 has a tongue 44 projecting inwardly thereon which is adapted to mate with a groove between a pair of parallel protrusions 46 extending from the shell 40. A tongue 48 also projects inwardly from the interior of the shell 42 and is adapted to mate with a groove between a pair of parallel projections 50 extending from the shell 40. A tongue 52, also shown in FIG. 4, extends inwardly from the interior of the shell 42 and is adapted to mate with a groove separating a pair of parallel protrusions 54 extending from the interior of the shell 40. The shells 40 and 42 may be joined by pressing each of them such that the tongues 44, 48, and 52 mate with the grooves in the extensions 46, 50, and 52. This causes the shell 40 and the shell 42 to overlie and completely enclose the core figure illustrated in FIG. 5, covering all but the arms 24 and 26 of the upper torso and head. The shells 40 and 42 may be removed by pulling them in the direction shown by the arrows in FIG. 3.

The hollow exterior shells 16 and 18 covering the arms 26 and 24 of the inner core figure are best illustrated in FIG. 2. These shells 16 and 18 may also be constructed of a moldable plastic such as ABS and are adapted to fit snugly over the inner arms 24 and 26. In a preferred embodiment of the invention, a series of small protrusions (such as spherical bumps 56) may be provided on the interior of the shells 16 and 18. In this preferred embodiment, the protrusions 56 are spherical in shape and have a radius of approximately 0.05 inches. The protrusions increase the frictional pressure of the interior of the shells 16 and 18 against the core arms 24 and 26 and thereby assure that the shells 16 and 18 will remain in place once affixed until removed by significant pressure.

While a single example of the invention has been provided, it will be obvious to those skilled in the art that various modifications and additions may be made without departing from the spirit and scope of the invention. For example, the lower limbs of a toy action figure might also be covered with outer shells to provide a more complete change of identity for the figure. Moreover a number of different shells might be utilized with a single figure to provide a number of different exterior identities. Consequently, it is intended that the invention be judged only by the claims appended hereto.

What is claimed is:

1. A toy action figure comprising an inner core depicting a first character and a removable outer shell covering the inner core and depicting a second character, said inner core including a figure having an upper torso, a head and two arms, said first character having two snake body formations extending from the torso to define the arms thereof.

2. A toy action figure as claimed in claim 1 in which the head of the first character is in the shape of a snake's head.

3. A toy action figure as claimed in claim 2 including a plurality of snake body formations encircling the torso.

* * * * *